US006568332B1

(12) United States Patent
Holzinger et al.

(10) Patent No.: US 6,568,332 B1
(45) Date of Patent: May 27, 2003

(54) GUIDEWAY FOR A MAGNETICALLY LEVITATED RAILWAY WITH LONGITUDINAL STATOR LINEAR DRIVE AND A PARTS SET AND METHOD FOR MAKING THE SAME

(75) Inventors: Gerhard Holzinger, Munich; Carsten Draudt, Hamburg; Falk Wolf, Dortmund, all of (DE)

(73) Assignee: Transrapid International GmbH & Co. KG, Berlin (DE)

( * ) Notice: Subject to any disclaimer, the term of this patent is extended or adjusted under 35 U.S.C. 154(b) by 11 days.

(21) Appl. No.: 09/619,726

(22) Filed: Jul. 19, 2000

(30) Foreign Application Priority Data

Jul. 21, 1999 (DE) ..... 199 34 912

(51) Int. Cl.[7] ..... B60L 13/04

(52) U.S. Cl. ..... 104/281; 104/282; 104/284; 104/286; 104/335; 104/306; 104/310; 104/255

(58) Field of Search ..... 104/281, 282, 104/284, 286; 335/306, 216; 310/12, 255, 254

(56) References Cited

U.S. PATENT DOCUMENTS

| | | | | |
|---|---|---|---|---|
| 4,055,123 A | * | 10/1977 | Heidelberg | 104/148 LM |
| 4,646,651 A | * | 3/1987 | Yamamura et al. | 104/281 |
| 5,097,769 A | * | 3/1992 | Raschbichler et al. | 104/124 |
| 5,152,227 A | * | 10/1992 | Kato | 104/286 |
| 5,213,047 A | * | 5/1993 | Fujiwara et al. | 104/281 |
| RE35,763 E | * | 4/1998 | Burgbacher | 310/51 |
| 5,850,794 A | * | 12/1998 | Reschnichler et al. | |

FOREIGN PATENT DOCUMENTS

| | | | |
|---|---|---|---|
| DE | 3335058 A1 | * | 4/1985 |
| DE | 34 04 061 C1 | | 9/1985 |
| DE | 33 23 696 C2 | | 3/1989 |
| DE | 39 28 277 C1 | | 12/1990 |
| DE | 39 28 278 A1 | | 2/1991 |
| DE | 196 20 221 A1 | | 5/1997 |

* cited by examiner

*Primary Examiner*—S. Joseph Morano
*Assistant Examiner*—Frantz F. Jules
(74) *Attorney, Agent, or Firm*—Michael J. Striker

(57) ABSTRACT

A guideway for a magnetically levitated railway is described, having a longitudinal stator linear drive comprising at least two parallel stators. The guideway includes a plurality of supports (1) arranged along a given line and adapted to form straight and curved guideway sections and stator sections mounted on the supports (1), these sections being composed of straight stator end packs (6*a, f*; 7*a, f*) and likewise straight middle stator packs (6*b*–3; 7*b–e*) arranged therebetween, the packs in the region of the curved guideway sections being laid in the manner of polygonal trains to form outer and inner stator sections (6, 7) and being separated from one another by gaps (23, 24). The stator end packs (6*a,f*; 7*a,f*) and the middle stator packs (6*b*–3; 7*b–e*) have a predetermined tooth/groove pitch (16) with reference to a conceptual space curve (2) and different "ideal" lengths which differ from one another by fractions of a tooth/groove pitch (16). The middle stator packs (6*b*–3; 7*b–e*) are so combined with one another in at least one outer or inner stator section (6, 7), taking into account their different "ideal" lengths, that a "material" total gap between the stator end packs (6*a,f;* 7*a,f*) and the middle stator packs (6*b*–3; 7*b–e*) of this stator section (6, 7) has the smallest possible width. A parts set and a method of making a double track guideway are also described (FIG. 2).

18 Claims, 7 Drawing Sheets

GUIDEWAY FOR A MAGNETICALLY LEVITATED RAILWAY WITH LONGITUDINAL STATOR LINEAR DRIVE AND A PARTS SET AND METHOD FOR MAKING THE SAME

BACKGROUND OF THE INVENTION

1. Field of the Invention

The invention relates to a guideway for a magnetically levitated railway with a longitudinal stator linear drive having at least two parallel stators and a parts set and a method for making the same.

The invention is particularly concerned with a guideway including a plurality of supports arranged along a given line and adapted to form straight and curved road sections, and stator sections which are mounted on the supports and are arranged along parallel space curve sections associated therewith and are assembled from straight stator end packs and straight middle stator packs arranged therebetween. The stator and stator end packs are laid out in the region of the curved road sections to form outer and inner stator sections in the manner of polygonal lines and are separated from one another by gaps. The stator end packs and the middle stator packs have, as referred to a conceptual space curve lying between space curve sections, a predetermined tooth/groove pitch as well as different "ideal" lengths, which differ from one another by fractions by a tooth/groove pitch.

The invention is further particularly concerned with a parts set for building guideways of the kind mentioned above and with a method of making a guideway for a magnetically levitated railway with curved and optionally also straight guideway sections, which form at least two tracks, are provided with stators of a longitudinal stator linear motor for each track and have outer and inner track sections in correspondence with their curvature. Two space curves associated with the tracks, at least one first and one second fixedly imposed point and a planning section disposed between these are established, wherein supports and their bearings for the guideway and the stators are arranged along the planning section and wherein the supports are provided with stator packs forming the stators.

2. Description of the Prior Art

Guideways and parts sets of this kind are known (DE 39 28 277 C2, DE 39 28 278 C2). The guideways can be erected with supports of concrete or steel, both on pillars or near to the ground, as required. All pieces of equipment needed to run the magnetically levitated railway are arranged on the supports, which are arranged one after the other in the direction of a previously determined line or route. This applies in particular to the side guide rails needed to guide the vehicles of a magnetically levitated railway and to the reaction rails in the form of stator packs or stator portions, needed to provide the support and drive and whose functional surfaces must lie accurately on space curves predetermined by the routing.

In order to simplify the erection of such a guideway the pieces of equipment, especially the stator packs, consist of linearly extending components, which approximate the space curve involved within curved guideway sections, in the manner of a polygonal line. The deviations from the ideal lines resulting from this are extremely small, since the radii of curvature of the guideways must not be less than about 350 m, for reasons of vehicle construction.

The functional surfaces of the stator packs formed as a rule on the underside of the guideway serve, in conjunction with the support magnets arranged on the vehicle, to create the magnet field between the vehicles and the guideway needed for the contact free levitation technology. The stator packs of a magnetically levitated railway are moreover provided with longitudinal stator linear drive, mostly also on the underside, with teeth and grooves alternating, in which a single or polyphase alternating current traveling field winding is fitted (DE 196 20 221 A1), which serves to generate the traveling field needed for the drive of the magnetically levitated railway. It is usual to provide identical linear drives on the two sides of the vehicle and accordingly to equip each side of a guideway with two parallel stators. Accordingly there are two separate but mechanically fixed together drive systems. In order that these can develop the same thrusts it is necessary that the pitch of the stator grooving is identical and runs synchronously on the two sides, as referred to a conceptual middle line between the two associated space curves, i.e. both stator sides must have identical tooth/groove pitches being the same throughout the whole length of the guideway.

The problem which arises in curved sections is that the space curves of the two stators have different lengths on account of their spacing, i.e. a space curve running along the inside of a curve is shorter that a space curve running along the outside of the same curve. This problem has hitherto been dealt with either by using stator packs of the same lengths and fitting the outer stator packs with greater material gaps than the inner stator packs or the outer stator packs have been made longer than the inner stator packs.

The use of stator packs of the same length is advantageous for constructional and cost reasons but also suffers from disadvantages. These lie in that different sized gaps distort the ideal distribution of the magnetic field of the longitudinal stator for example. Since the individual stator packs are comparatively short (e.g. 1000 mm to 2000 mm), this leads to rapid periodic variations in the forces with which the vehicle is maintained in the levitated state as it traverses the stator packs, with the result that oscillations can be excited in parts of the guideway or of the vehicle. These oscillations may not only affect the life of all elements of the guideway and the vehicle, but can also adversely affect the comfort of the ride and the generation of noise. This problem can be avoided in principle by using longer outer stator packs but this would have the disadvantage that special stator packs would have to be made for all radii of curvature down to about 350 m, which is undesirable for reasons of cost. Accordingly, stator packs with correspondingly matched lengths are associated in practice only with selected ranges of radii of curvature, so that even using this method, large gap widths have to be tolerated at least to some extent.

In addition, with guideways of the kind of interest here, it is desirable for the stator packs composed of individual laminations or sheets to be enveloped in an anti-corrosion coating of one to two millimeters for example, in order to avoid over-rapid corrosion. However, in magnetic terms, this has the consequence that there is a gap imposed by the protective coating in addition to the material gap already mentioned, so that the magnetic gap which is important for the support and traveling properties of the vehicle is still wider than the pure material gap occurring between the adjoining end faces of the stator packs. The material gaps should therefore be kept as small as possible.

The problem of the magnet gap size is intensified when the manufacture of guideways with at least two tracks, e.g. an up and a down track, is involved. In this case the difference between the lengths of the innermost space curve sections and the outermost space curve sections is still greater in curved guideway sections, which leads to the result that, with the use of like stator packs and supports, either an offset between the two tracks has to be accepted or special steps such as deviations from a predetermined tooth/groove pitch for example have to be taken, which further affect the ride and support properties.

SUMMARY OF THE INVENTION

It is, therefore, an object of this invention to design the guideway described above such that periodic alterations in the supporting forces during travel of the magnetic levitated railway are largely avoided.

A further object of this invention is to avoid periodic alterations in the supporting forces during travel even when stator packs with only a few different lengths are used.

Yet another object of this invention is to provide a parts set including stator packs, stator end packs and series supports for easily building guideways of the kind specified above and having gaps between the stator packs and stator end packs, which gaps are so small that periodic alterations in the supporting forces during travel of the magnetic levitated railway are largely avoided.

A further object of this invention is to provide a method for making guideways which method is suitable in particular for making guideways with two or more tracks one beside the other.

Yet another object is to provide a method such that stator packs, stator end packs and supports of only a few different sizes can be used without resulting in undesirably large offsets between associated supports of the tracks or in other disturbances.

These and other objects are solved by a guideway, a part set and a method in accordance with this invention.

The guideway of this invention is characterized in that the middle stator packs are so combined with one another in at least one outer or inner stator section under consideration of their different "ideal" lengths in such a manner that a "material" total gap between the stator end packs and the middle stator packs of this stator section has the smallest possible width. The parts set of this invention is characterized in that it contains a plurality of stator packs, stator end packs and series supports a s specified above with respect to the guideway of this invention.

The method according to this invention is characterized in that the spacing between the two fixedly imposed points is so determined that the space curve of that track which adjoins the second fixedly imposed point with an outer track section has a length which corresponds to an integral multiple of a predetermined tooth/groove pitch for the guideway, further in that series supports from the parts set according to this invention are arranged along the currently outer track section, staring from the first fixedly imposed point, while supports which are shorter than the series supports by integral multiples of the tooth/groove pitch are arranged along the currently inner section, wherein the shortening of these supports is so effected that their ends are offset relative to the ends of an associated series support of the outer track section by half a tooth/groove pitch at the most, and in that all supports are fitted with stator packs and stator end packs from the parts set of this invention.

The invention is based on the recognition that large stator gaps and the effects arising therefrom c an be largely avoided in that the guideway is not only assembled from a small number of stator pack types of different lengths, but these stator packs are so combined with one another in each stator section that the currently most favorable gap widths result. This can be achieved with no alteration or only a very slight alteration of the pitch of the stator grooving. This leads to a further advantage, in that the supports to be employed can be standardized and grouped in a few types. In spite of minimal increases in cost for making the different stator types, this leads to substantial advantages in relation to the routing and planning of different road or guideway configurations as well as in the logistics needed for the building of a guideway.

Further advantageous features of the invention appear from the dependent claims.

BRIEF DESCRIPTION OF THE DRAWINGS

The invention will now be explained in more detail in conjunction with the accompanying drawings of embodiments, in which.

DETAILED DESCRIPTION OF THE PREFERRED EMBODIMENTS

Figure 1:
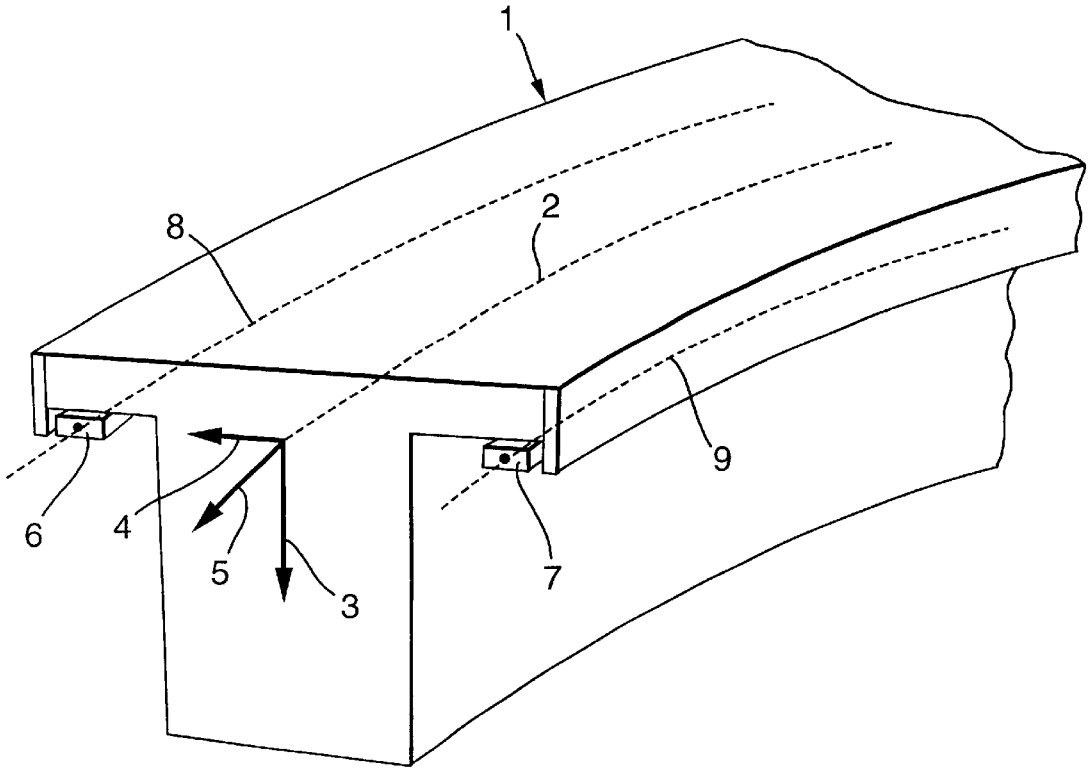
FIG. 1 is a schematic and perspective view of a support for a guideway according to the invention.

FIG. 1 shows a support 1 consisting of steel or concrete, which is adapted for erection of a road or guideway according to the invention for a magnetically levitated railway with a longitudinal stator linear drive (motor) having at least two parallel stators. In the embodiment this concerns a support 1 which is curved along a predetermined route or line, as is indicated by a space curve 2 shown in its central plane. A Cartesian coordinate system is also shown schematically, with axes 3, 4 and 5 perpendicular to one another. The support 1 and the stators can be curved about all three axes, where curvature about the axis 3 represents traveling round a curve, curvature about the axis 4 passage uphill or downhill and curvature about the axis 5 a tilt in the sense of super-elevation.

Stator sections 6 and 7 are mounted on the underside of the support 1 on the two sides respectively of the space curve 2, wherein the stator section 6 lies in the embodiment on the outside of an arc about the axis 3, while the stator section 7 lies on the inside of this arc. The stator sections 6 and 7 are disposed along space curves 8 and 9, which have the space curve 2 of the support 1 as a common center line for example. It will be understood that this only applies as an example, i.e. the positions of the space curves 2, 8 and 9 can also be defined in a different way. It would for example alternatively be possible to arrange the space curves 2, 8 and 9 in a plane which lies in the air-gap to be produced between the longitudinal stator and the support magnets of the vehicle. The stator sections 6 and 7 each consist of a plurality of stator packs or stator portions, which are arranged like a polygonal train one after the other in the directions of the space curves 8 and 9 respectively. Their attachment to the support 1 can be effected by various methods known per se. Moreover the whole guideway, not shown in the drawing, consists of a plurality of supports 1 arranged one after the other in the direction of the space curve 2 and which can be straight or curved, depending on the characteristics of the route. Finally, the supports 1 are mounted in a manner known per se on pillars or other sub-structure by means of a fixed bearing in a central part and by means of a free bearing at each of the two ends, so that they are divided into two spans. Other supports having only one span or more than two spans and differently arranged fixed and free bearings can be provided.

Supports of the described kind, their mounting, the attachment of the stator packs to the supports and the mounting of three-phase alternating current windings for example in the grooves of the stator sections 6 and 7 are generally known (DE 33 23 696 C2, DE 34 04 061 C1, DE 39 28 277 C1, DE 39 28 278 C2) and therefore do not need to be described in more detail, but are incorporated by reference to those documents into the subject matter of the present disclosure in order to avoid repetition.

Figure 2:
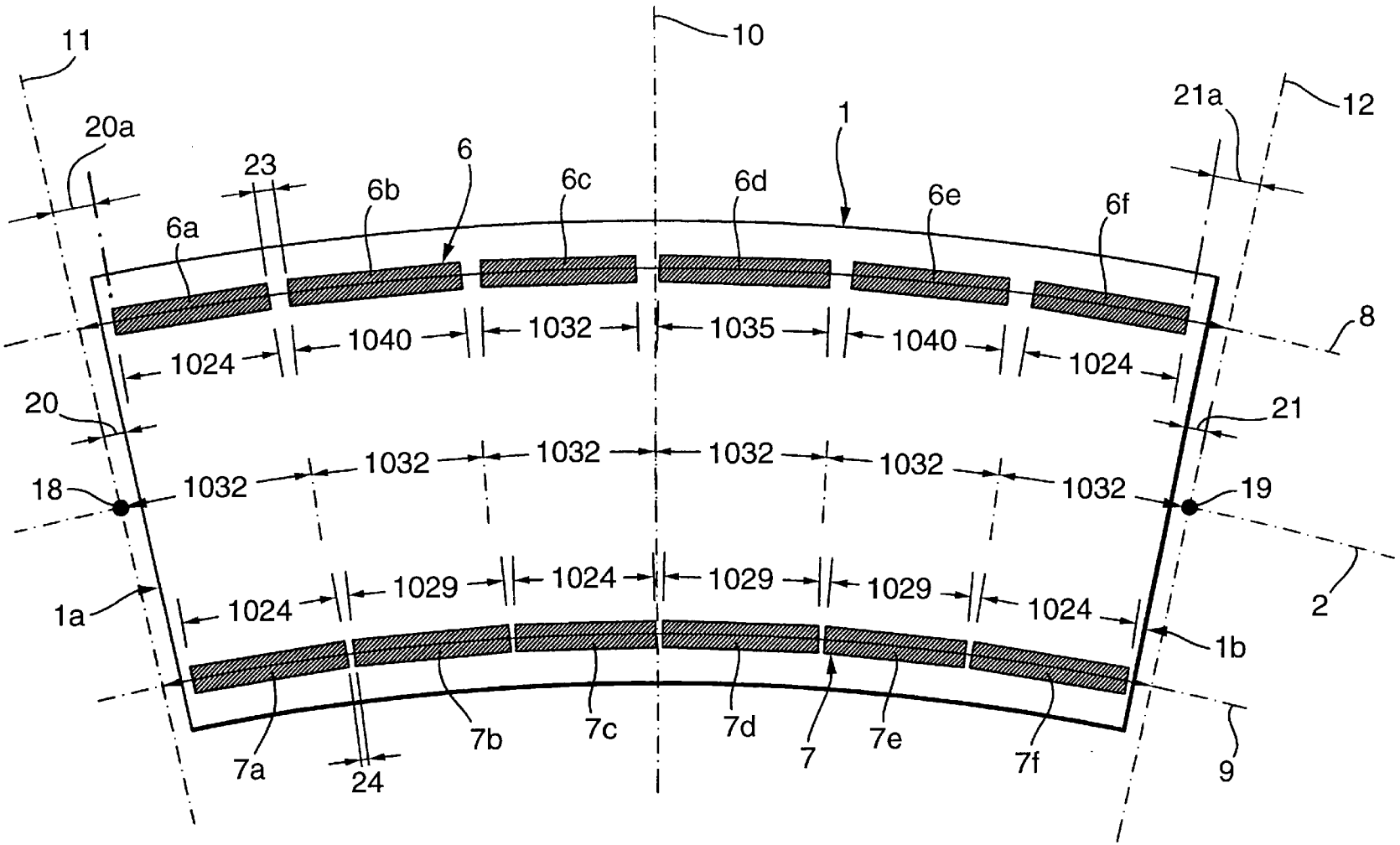
FIG. 2 is a schematic plan view of a curved guideway section using a support according to FIG. 1, wherein the stator packs arranged underneath the support surface are indicated by hatched lines.

FIG. 2 is a plan view of the support 1 according to FIG. 1. The projections of the space curves 2, 8 and 9 are accordingly circles in the embodiment but can be any other arbitrary curves, such as spiral transition curves or sinusoids. FIG. 2 further shows that the support 1 has a conceptual central plane denoted by a chain-dotted line 10 and lies between two conceptual planes 11 and 12 which are indicated by chain-dotted lines and are normal or perpendicular to the space curves 2, 8 and 9. The axes of the fixed and free (movable) bearings of the support, not shown, can also be arranged normal to the space curves 2, 8 and 9 and the same can apply to the start 1*a* and end 1*b* of the support. Such an arrangement is particular advantageous for making guideways with two tracks (e.g. up and down tracks), each with two stators.

Figure 3:
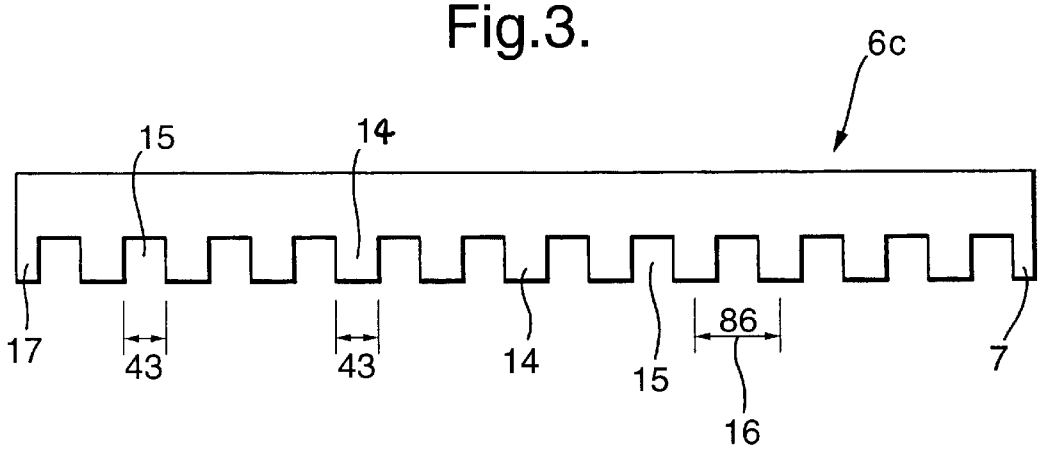
FIG. 3 is a side view of a normal, "first" pack.

The stator sections 6 and 7 fixed on the support 1 consist in this embodiment of six straight stator portions or stator packs each, 6*a* to 6*f* and 7*a* to 7*f*. Each of these stator packs has the general form seen in FIG. 3, shown for the stator pack 6*c* and has alternating teeth 14 and grooves 15 of equal length on its underside, which have a predetermined pitch value, i.e. a predetermined tooth/groove pitch 16, referred to the space curve 2. End teeth 17 at the ends normally have only half the width of the other teeth 14, so that the end teeth 17 of two adjoining stator packs together form a tooth of the length of one tooth 14.

In accordance with the invention the supports 1 are, regardless of whether they are straight or curved, arranged between two points 18 and 19 (FIG. 2) of the space curve 2 lying in the planes 11 and 12, the spacing between these points being an integral multiple of the tooth/groove pitch 16. The supports 1 are shorter in the route direction (space curve 2) by an amount which allows a gap 20, 21 to be left between the support starts 1*a* and ends 1*b* and the associated conceptual planes 11 and 12, these gaps in conjunction with a corresponding gap 21 or 20 of an adjoining support forming an expansion gap. It is essential to observe that a sufficiently large expansion gap 20*a*, 21*a* is formed between stator end packs 6*a*, 6*f* and 7*a*, 7*f* coming to lie at the support starts and ends 1*a* and 1*b* and that the stator packs 6*a*, 6*f* and 7*a*, 7*f* are so arranged that abutment of the stator packs in this region or squashing the stator winding therebetween is ruled out, even at the highest anticipated temperatures, as well as under all other stresses arising during operation.

As FIG. 2 shows, the space curve sections between the planes 11 and 12 have different lengths, i.e. the spacing of the planes 11, 12 measured along the space curve 8 is longer than the spacing measured along the space curve 9. Therefore, if all stator packs would have the same material total length, gaps 23 formed between stator packs 6*a* to 6*f* of the stator section 6 would inevitably be greater than the gaps 24 formed between the stator packs 7*a* to 7*f* of the stator section 7, which can lead to exciting the oscillations mentioned in the introduction, especially in smaller radii of curvature, on account of the unequal support forces when passing over the gaps 23, 24.

Accordingly it is proposed in accordance with the invention to provide three types for the middle stator packs lying between the stator end packs 6*a*, 6*f*, 7*a*, 7*f* of the inner and outer stator sections 6 and 7, namely "first", "second" and "third" stator packs. All stator packs are straight. The "first" stator packs have a middle length. The length of the "first" stator packs is so selected that the spacing between the points 18 and 19 can divided by this length, with no remainder, or conversely the spacing between the points 18 and 19 is of such a size that it is an integral multiple both of the tooth/groove pitch 16 and also of the length of the "first" stator packs. In contrast to this, the "second" stator packs have a greater length and the "third" stator packs a smaller length than the "first" stator packs. Moreover the outer and inner stator sections 6 and 7 are so assembled from "first", "second" and "third" stator packs that the material gaps 23, 24 between these stator packs as well as between these stator packs and the stator end packs can all be made smaller than a predetermined maximum gap size. This condition can be met according to the invention in particular when the material overall gap of a stator section 6 or 7, i.e. the sum of its gaps 23 or 24 in each case takes the smallest value which can be achieved by combinations of the "first", "second" and "third" stator packs.

FIGS. 2 and 3 show this with reference to a simple embodiment, which is explained below.

It is assumed that the pitch value or tooth/groove pitch amounts to 86 mm. In the "first" stator packs the tooth and groove length is therefore 43 mm in each case, while the end teeth 17 are half as long at 21.5 mm, so that the length of the "first" stator packs is an integral multiple of the pitch length. A total length of 1032 mm results for the "first" stator packs (e.g. 6*c* in FIGS. 2 and 3) with the presence of twelve grooves 15, eleven teeth 14 and two end teeth 17. If six such stator packs are mounted per support 1 as in the embodiment, the spacing between the points 18 and 19 is six times as large, i.e. a system length of 6192 mm is selected, which corresponds to the 72 times multiple of the tooth/groove pitch 16. This system spacing is repeated in the route direction as often as the supports 1 are employed.

It is further assumed that the support 1 is curved along a space curve 2 with a radius of 350 m about the axis 3 and has a transverse cant about the axis 5 of twelve degrees, while the longitudinal inclination about the axis 4 is fixed at 0°. In this case the section of the outer space curve 8 lying between the axes 11, 12 has a length of 6212.51 mm for example and the corresponding section of the inner space curve 9 has a length of 6174.09 mm for example, which means a difference of 38.42 mm. When using six "first" stator packs and five gaps 23, 24 in each case, this leads to a mean width of the gaps 23 on the outside of about 4.1 mm while on the inside, even with a width of the gaps 24 of 0 mm, a length of the stator section 7 would result which is greater than the spacing of the planes 11, 12 along the space curve 9.

In order to reduce the outer gap width, the outer stator section has one stator pack (e.g. 6*d* in FIG. 2) with a length of 1035 mm and two further stator packs (e.g. 6*b* and 6*e* in FIG. 2) are each 1040 mm long. These stator packs 6*b*, 6*d* and 6*e* extended in length as compared with the "first" stator packs 1032 mm are called "second" stator packs below. Their effect is that the stator section 6 has an overall length of 3·1032 mm+2·1040 mm+1·1035 mm=6211 mm, whereby a difference of only 1.51 mm results from the length given above of the space curve section in question of 6212.51 mm, which corresponds to a mean gap width of only about 0.3 mm per gap 23.

Figure 4:
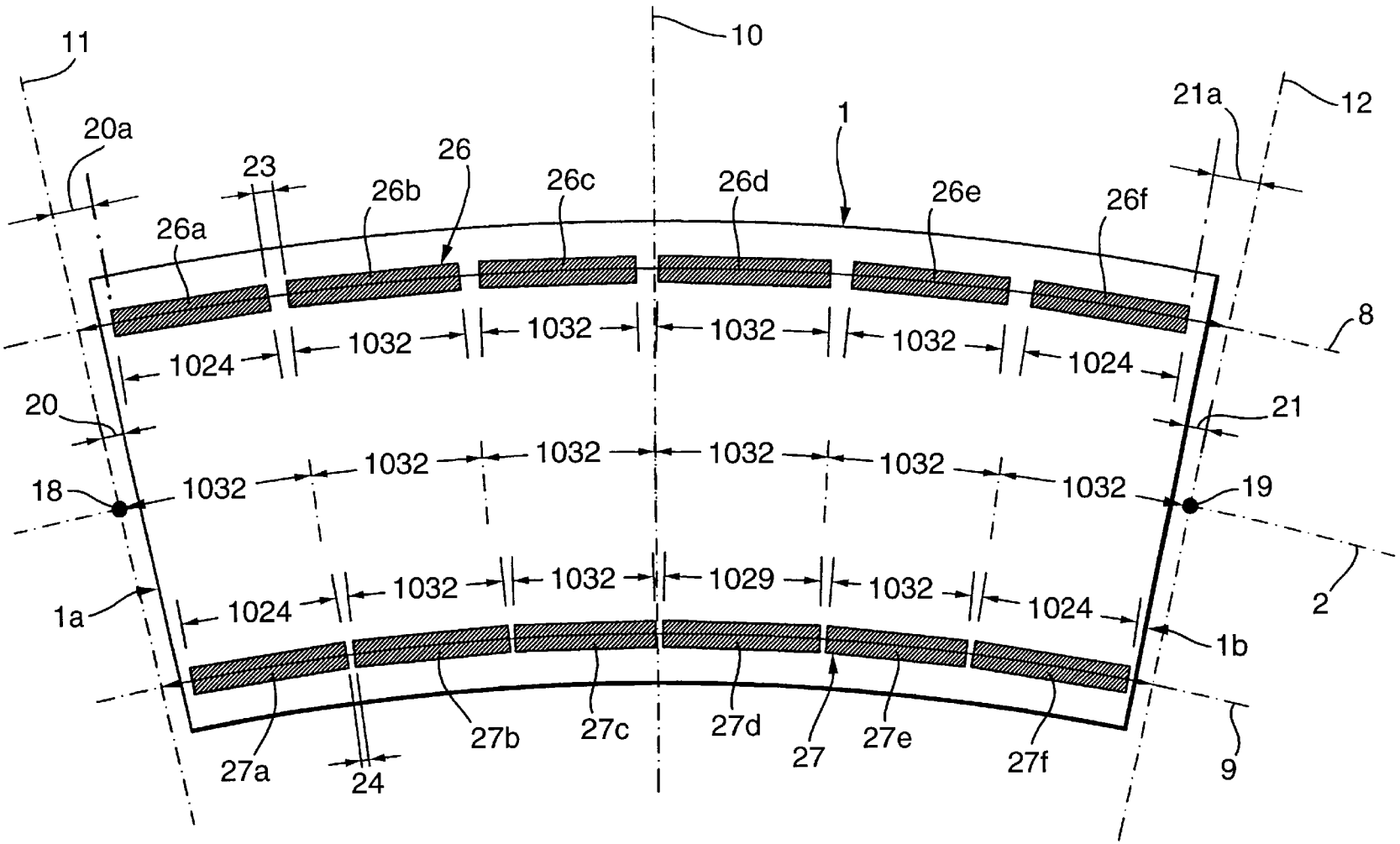
FIG. 4 is a view corresponding to FIG. 2 of a second embodiment of a guideway section.

In a second embodiment seen in FIG. 4, with otherwise equal dimensions, a support 1 is assumed with a radius of curvature of 5000 mm about the axis 3 in FIG. 1. The distance between the points 18, 19 amounts as in FIG. 2 to 6·1032 mm=6192 mm. In contrast to FIG. 2 the space curve sections between the axes 11 and 12 have a length on the outside of 6193.44 mm for example and a length inside of 6190.75 mm for example, which corresponds to a difference of only 2.69 mm. In this example six "first" stator packs 26*a* to 26*f* are fitted, which results in an overall length of 6·1032 mm=6192 mm, which is only 1.44 mm smaller than is the case for the space curve section in question. With five gaps a total gap of 1.44 mm thus results, or a mean gap length of about 0.29 mm, which is comparable with the example according to FIG. 2.

Somewhat different conditions apply in each case to the stator section lying on the inside. If the stator packs laid along the space curve 9 were to have a length of 1032 mm each, their total length would be too great compared with the spacing between the planes 11, 12 of 6174.09 mm, even with disappearance of the gaps 24. Accordingly "third" stator packs 7*b*, 7*c*, 7*d* and 7*e* with lengths of 1029 mm and 1024 mm are provided, where the stator packs 7*b*, 7*d* and 7*e* in FIG. 2 each have a length of 1029 mm and the stator pack 7*c* is 1024 mm long. If the stator end packs also consist of "first" stator packs, an overall length will result of 3·1029 mm+1·1024 mm+2·1032 mm=6175 mm, which is in all only 0.91 mm more than the spacing of the axes 11, 12 along the space curve 9 amounting to 6174.09 mm. This small excess is insignificant, since, according to a particularly preferred embodiment of the invention, stator end packs 6*a*, 6*f* and 7*a*, 7*f* are provided in each case at the joints between two supports 1 which have a length of only 1024 mm, instead of 1032 mm. In this way account is taken of the provision of expansion gaps 20*a* and 21*a* at the joints between two stator sections 6 or 7, which gaps have a width of 16 mm in all in the embodiment. Each stator end pack 6*a*, 6*f* or 7*a*, 7*f* is therefore shorter by half such an expansion gap. If on the other hand, there is a particularly unfavorable case, as applies for the inner stator section 7 in FIG. 2, the inner stator end packs 7*a*, 7*f* can also be so placed that they project into the expansion gap, preferably by half each, i.e. here by 0.455 mm each at the start 1*a* and end 1*b* of the support 1. The result of this is that, when two identical supports adjoin, an expansion gap occurs between the inner stator sections 7 of only 16 mm−0.91 mm=15.09 mm. Since the length of the expansion gap is selected with a certain excess, the shortening by 0.91 mm can easily be tolerated.

In the case of FIG. 4, using six "first" stator packs 27*a*–27*f* in an inner stator section 27 would result in a total length of 6·1032=6192 mm, which is 1.25 mm more than the spacing of the two axes 11, 12 from one another of 6190.75 mm. In order to avoid the stator packs 27*a*, 27*f* having to project into the expansion gap, one of the "first" stator packs is replaced by a "third" stator pack (e.g. 27*d*) with a length of 1029 mm. A total length of the stator packs 27*a*–27*f* is then computed as 5·1032 mm+1·1029 mm=6189 mm, which corresponds to a difference of 1.75 mm from the length of the space curve section in question, and to a mean gap width of 0.35 mm.

In the above description the lengths of the stator sections 6, 7, 26 and 27 were always referred to the planes 11, 12. If on the other hand, as was explained in connection with the inner stator section 7 in FIG. 2, an expansion gap of 16 mm is the basic provision, the lengths of the stator end packs 6*a*, 6*f* and 7*a*, 7*f*, etc., can also be said to be throughout 1024 mm (length of the stator section)+8 mm (half an expansion gap). The size of 1032 for this stator end pack is then an "ideal" size, which includes half the expansion gap 20 or 21. It is moreover clear that the starts and ends 1*a*, 1*b* of the supports 1 and the ends of the stator sections do not always have to be flush with one another. It is also perfectly conceivable for the spacing of the support starts and ends 1*a*, 1*b* along the space curve 8, 9 to be chosen shorter or longer than the corresponding overall length of the stator sections 6, 7 or 26, 27.

It is advantageous to denote the given lengths both for the middle stator packs and for the stator end packs as "ideal" lengths. Stator packs of the kind here of interest are produced for example in that suitably cut electro-laminations (sheets) are stacked and then enveloped in a coating in the form of a corrosion protector and/or insulating layer, using a pressure gelation process for example (cf. DE 197 03 497 A1 for example). The conditions seen in FIGS. 5 to 7 accordingly arise in the case of practical applications.

Figure 5:
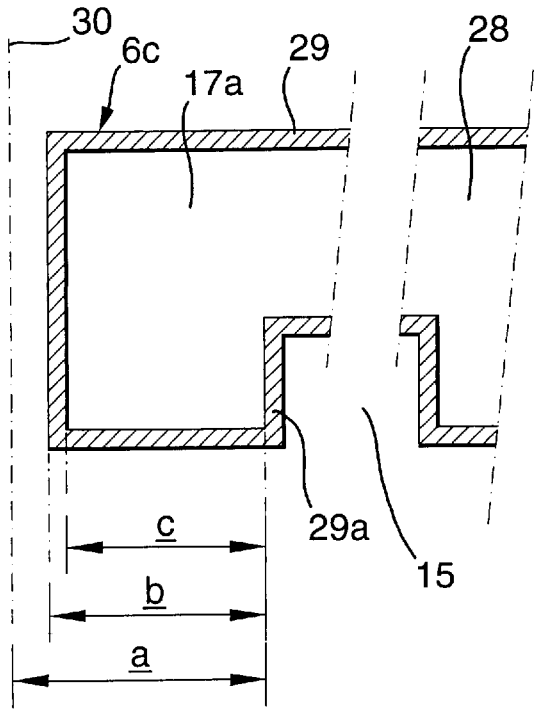
FIGS. 5 to 7 are side views enlarged compared with FIG. 3 of an end tooth of "first" and "second" stator packs and stator end packs, all formed in accordance with the invention.

In FIG. 5 there is shown an end tooth 17*a* (comparable for example with the left end tooth 17 in FIG. 3) of a "first" stator pack (6*c* in FIG. 2). Accordingly, the stator pack 6*c* comprises a sheet stack or a stack of laminations 28, respectively, which is surrounded all round by a 1 mm thick coating 29 for example. The pack of laminations 28 is produced with reference to the pitch factor (86 mm in the embodiment), since it alone is responsible for the magnetic properties. The pack of laminations 28 therefore determines the "magnetic" length of the stator pack 6*c*. It follows from this that the teeth 14 and grooves 15, regarded magnetically, have a length of 43 mm each for example, while the grooves 15, regarded "materially" have a length of only 43 mm−2 mm=41 mm, on account of the coating 29, which is unimportant to the magnetic situation. At the two ends of the stator pack 6*c* the coating 29 must however be taken into account, because two end teeth here adjoin one another at a conceptual ideal line or plane 30. Moreover it has to be observed that two stator packs do not adjoin with formation of an ideal gap of 0 mm, but actual assembly gaps of 0.2 mm for example have to be observed. If half such an assembly gap is taken into account at each end of a stator pack, as is indicated in FIG. 5 by the line 30, the result is that the end tooth 17*a* should have as a whole an "ideal" length a of 21.5 mm, a "material" length b of 21.4 mm and a "magnetic" length c of 20.4 mm. The amount a−b=0.1 mm automatically takes account of the assembly gap of 0.2 mm in all, which is not materially apparent but has to be taken into account in assembly of the stator pack.

In relation to the lengths given with reference to FIGS. 2 and 4, this means that, taking into account the fact that each stator pack has two end teeth 17 (FIG. 3), a "first" stator pack 6*c* has—in accordance with this invention—an "ideal" length of 1032 mm, a material length of 1031.8 mm and a "magnetic" length of 1029.8 mm. The disturbance to the magnetic field which results from the shortening of the sheet length of the end tooth 17*a* by 1.1 mm is tolerable in relation to the supporting and ride properties of a magnetically levitated railway.

Figure 6:
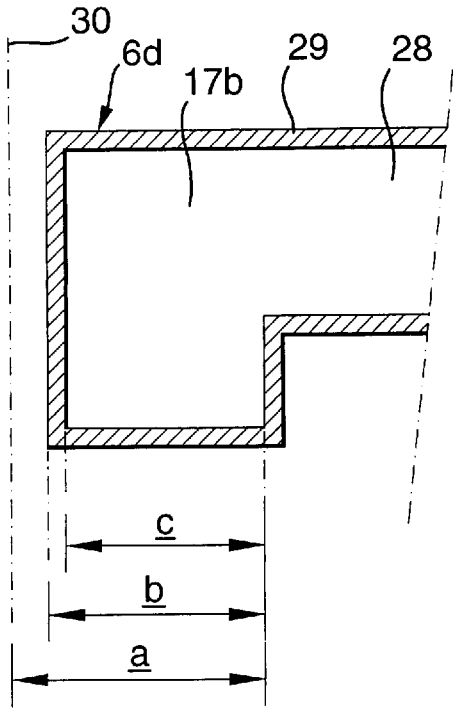

FIG. 6 shows the conditions for a "second" stator pack (e.g. 6*d* in FIG. 2) with a length of 1035 mm. Since the stator pack 6*d* is as a whole 3 mm longer than the stator pack 6*c* according to FIG. 5, at each end an end tooth 17*b* has, with otherwise like properties, the values a=23.0 mm, b=22.9 mm and C=21.9 mm, i.e. the "magnetic" length of each end tooth is 1.5 mm longer compared with FIG. 5. Overall the stator pack 6*d* thus has an "ideal" length of 1035 mm, a "material" length of 1034.8 mm and a "magnetic" length of 1032.8 mm.

If a "second" stator pack has a length of 1040 mm (e.g. 6*e* in FIG. 2), then the amount c=24.4 mm. If however a "third" stator pack is in question, whose lengths are reduced compared with the "first" stator packs, an amount c=18.9 mm would arise with an "ideal" length of 1029 mm (e.g. 7*b* in FIG. 2) and an amount c=16.4 mm with an "ideal" length of 1024 mm (e.g. 7*c* in FIG. 2).

Figure 7:
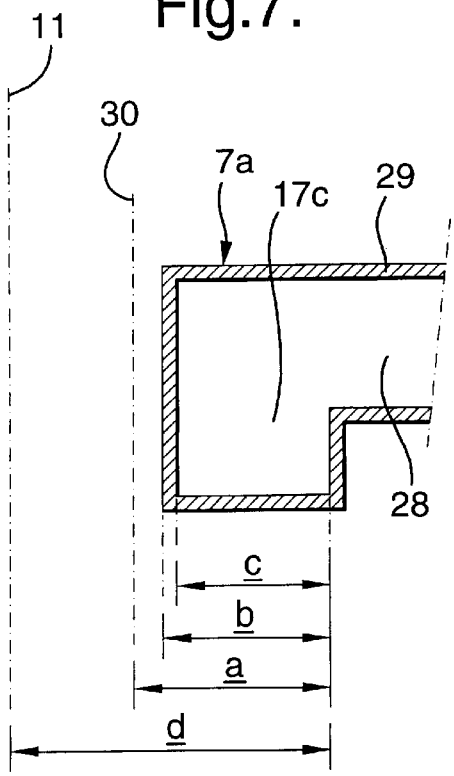

Finally, FIG. 7 shows an end tooth 17*c* for a stator end pack 7*a* in FIG. 2. The "ideal" length of 1024 mm is here not calculated up to a line 30 which takes into account an assembly gap, but to the plane 11 in FIG. 2 for example, which also includes half of an expansion gap, i.e. an additional 8 mm gap width. In this case the end tooth 17*c* has a "magnetic" length of only c=12.4 mm, a "material" length b=13.4 mm and an "ideal" length d=13.4 mm+0.1 mm (assembly gap component)+8 mm (expansion gap component)=21.5 mm. The second end tooth of the stator pack 7*a* corresponds to that of the stator pack 6*c* according to FIG. 5.

On the basis of the situation described with reference to FIG. 7, the "ideal" length of the end tooth 17*c* with d=21.5 mm is just as long as the "ideal" length of the end tooth 17*a* according to FIG. 5. If therefore two such stator packs adjoin in the region of an expansion gap, then the total tooth length amounts to 2·21.5 mm=43 mm, i.e. there is indeed a disturbance on account of the small "magnetic" length but there is no alteration in the tooth/groove pitch. Since such disturbances moreover only occur in the region between two supports 1 and therefore do not occur with the periodicity corresponding to the stator pack length, they are comparatively unimportant. This is especially the case when supports are normally used which are longer than the supports 1 by a multiple of the tooth/groove pitch. Moreover the stator end pack 7*a* is so designed that it can also be used as the stator pack 7*b* as a "third" stator pack.

The use of the "second" and "third" stator packs is effected as with the stator end packs taking into account the tooth/groove pitch. The joint between the stator packs 6*c* and 6*d* is shown as an example in FIG. 8, wherein a double arrow M designates the "magnetic" gap, whereas a double arrow N denotes the "material" gap. The amount a−b (e.g.=0.1 mm) here signifies as in FIGS. 5 and 6 the proportion of the assumed assembly gap of 0.2 mm at each of the stator packs 6*c*, 6*d* while an amount e (e.g.=0.3 mm) signifies and additional gap component which results from the difference explained above with reference to FIG. 2 of 1.51 mm between the "ideal" outer stator section length and the length of the space curve 8 between the planes 11, 12. The magnetic field disturbance remaining according to the invention arises from the two adjoining end teeth 17*a*, 17*b* together have an "ideal" length of 21.5 mm+23.0 mm+0.3 mm=44.8 mm, instead of 43 mm. The pitching moreover remains unaltered.

Figure 9:
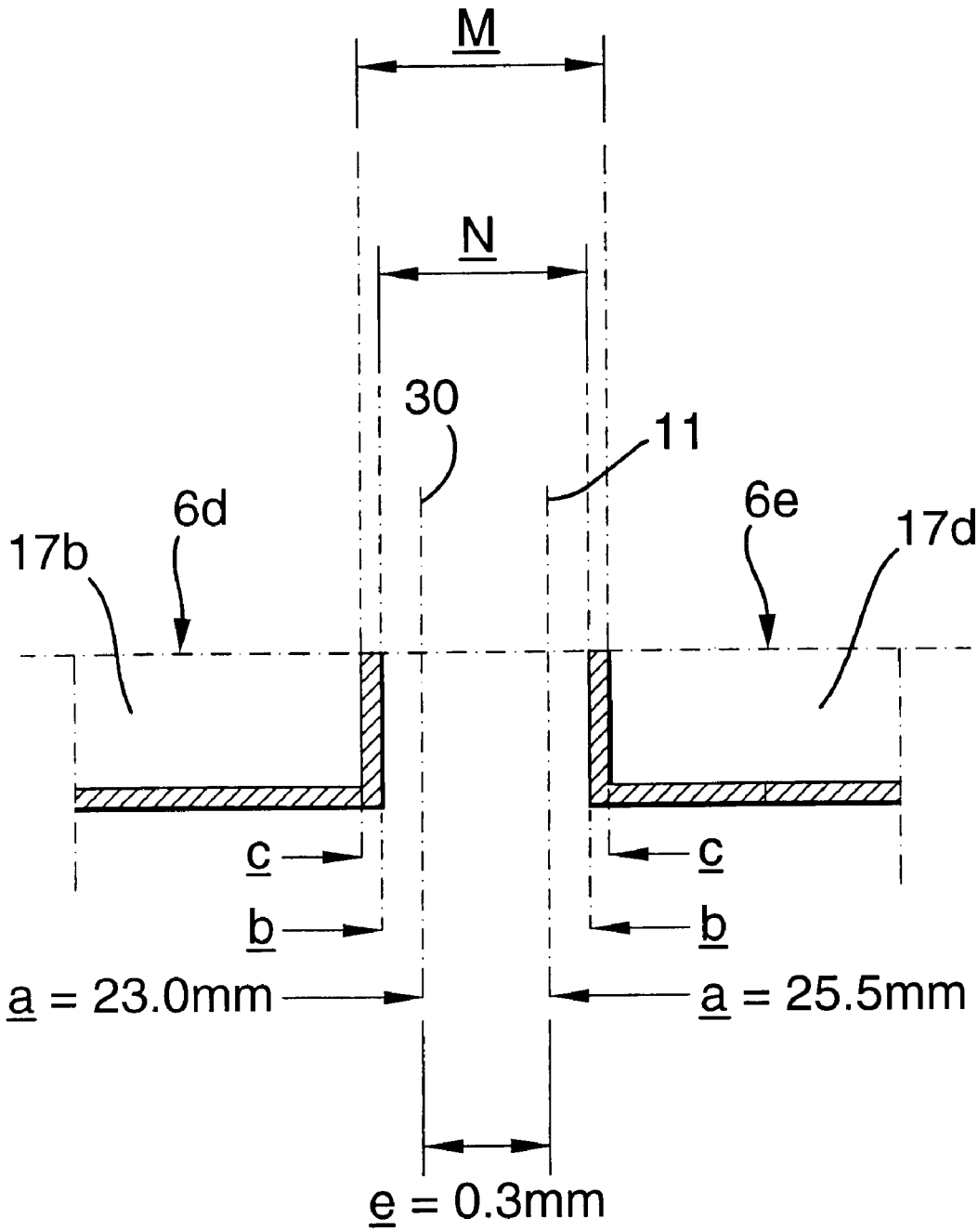
FIG. 9 is an enlarged side view of two "second" stator packs of different lengths adjoining one another in the region of a gap.

Finally FIG. 9 shows a joint between the stator packs 6*d* and 6*e*. Since an end tooth 17*d* of the stator pack 6*e* has an ideal length of 25.5 mm, the total length of the tooth formed by the two stator packs 6*d*, 6*e* here amounts to 23 mm+25.5 mm+0.3 mm=48.8 mm, instead of 43 mm. The pitching moreover remains unaltered.

Figure 8:
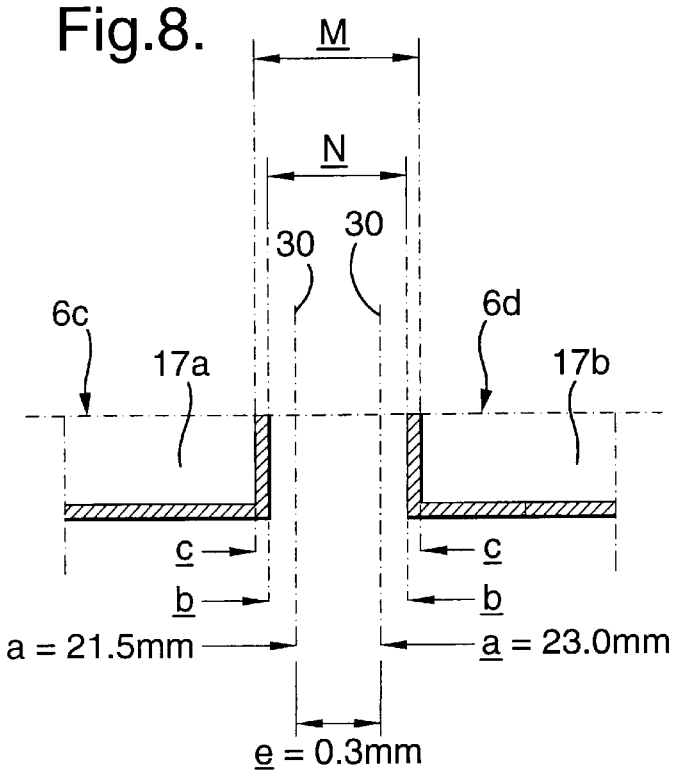
FIG. 8 is an enlarged side view of two "first" and "second" stator packs adjoining one another in the region of a gap.

The result of the alterations of the lengths of the end teeth by fractions of a tooth/groove pitch 16 (FIG. 3) in accordance with the invention is that the "magnetic" gaps M between the end teeth determining the support properties of a vehicle of the magnetically levitated railway remain very small, even in the least favorable cases (e.g. 2.5 mm in FIGS. 8 and 9). Accordingly the risk of mechanical oscillations building up is substantially reduced. On the other hand the magnetic field disturbances responsible for the drive remain small in the region between two end teeth, so that there is no adverse effect on the ride comfort. Finally, by sensible combination of the described five different middle stator packs, to which a stator end pack is added at each of the support starts and ends 1*a*, 1*b*, practically all guideway configurations with curvatures down to radii of curvature of 350 m for example can be realized, without gaps arising in the joints of the stator packs within a support 1 which have a greater width than a predetermined maximum "material" gap width N (FIGS. 8, 9) of about 0.6 mm for example (including 0.2 mm assembly gap).

The described middle stator packs and stator end packs are advantageously so combined with one another that $-1\ \text{mm} \leqq G < 2\ \text{mm}$ where G is the difference between the length of a space curve section associated with a stator section 6, 7, 26, 27 between the planes 11 and 12 and the sum of the "ideal" lengths of the middle stator packs and stator end packs contained in this stator section. G is thus a measure of a material total gap width which is to be taken into account within a stator section, in addition to the assembly gaps and the gaps resulting from the coating. If the amount G is distributed equally over all middle stator packs and stator end packs contained within a stator section 6, 7, 26, 27, with $G<2$ mm a mean gap in addition to the other recited gaps results which is less than 0.4 mm. In the case in which $-1\ \text{mm}<G$ applies however, the additional material total gap imposed by the curvature is G=0, since in this case the excess stator pack length is put into the expansion gap.

The use of the "second" and "third" stator packs and the stator end packs having regard for the predetermined tooth/groove pitch can alternatively be implemented in that the alteration in the length of the end teeth explained with reference to FIGS. 5 to 7 is distributed proportionately over all teeth and grooves present in a stator pack. With 24 teeth/grooves in all and a change in length of 3 mm for example, this would mean an alteration in the pitching or tooth/groove pitch of 0.125 mm, which is not significant, either in relation to the supporting properties nor in relation to the ride properties. A further possibility lies in distributing the alteration in the length of the end teeth solely over the teeth which are present, which would correspond to a permissible alteration in length of the teeth of 0.25 mm and would have the advantage that the width of the grooves 15 stays unchanged, as is desirable for reliable installation of the alternating current cable.

The invention has been explained with reference to a support 1 with a length measured between the points 18 and 19 of 6192 mm. However, it is clear that supports with other lengths could be used. In accordance with an embodiment of the invention which is deemed to be the best one up to now, it is proposed to use two further supports, which are four and ten times as long as the supports 1 and can be fitted with the same described stator packs. When using these supports the spacing of the corresponding points 18, 19 of 24,768 mm or 61,920 mm is likewise equal to an integral multiple both of the tooth/groove pitch and of the length of the "first" stator pack. These two supports are called series supports below, like the supports 1.

If the spacing of the points 18, 19 amounts to 61,920 mm for example, an expansion gap of 86 mm is preferably provided between successive supports or the associated stator packs. In order to realize this gap a further stator end pack with an "ideal" length of 1032 mm is used analogously to the above description, but in distinction from the stator end packs 6*a*, 6*f*, etc. has a "material" length of 945.8 mm and a "magnetic" length of 943.8 mm. This stator end pack differs from the "first" stator packs in that it is shortened by exactly one tooth/groove pitch 16 of 86 mm and therefore its "ideal" length includes at one end thereof an assembly gap component of 0.1 mm and an expansion gap component of 86 mm. In contrast to the supports 1 it is moreover provided with series supports of this length that the expansion gap of 86 mm is present only once in the joint between two supports, i.e. the associated starts or ends of the adjoining supports are formed normally. As in the case of the 1024 mm long stator end packs the materially 945.8 mm long stator end packs can also be used as "third" stator packs.

Having regard for these measurements, the result for a support with a radius of curvature of 350 m for example about the axis 3 in FIG. 1 and with a longitudinal and transverse inclination about the axes 4 and 5 of 0° in each case is for example a total length on the inner side of 61,723.63 mm and a total length on the outer side of 62,116,37 mm between the planes 11 and 12 and along the space curves 9 and 8 respectively. The inner stator section is implemented as follows for example: 55 "third" stator packs with an "ideal" length of 1029 mm and four "third" stator packs with an "ideal" length of 1024 mm are used and moreover at the start or end of the support, a stator end pack with an "ideal" length of 1032 mm and a "material" length of 945,8 mm is fitted. The result is then 55·1029 mm+4·1024 mm+1·1032 mm=61,723 mm, from which there results a total deviation of only G=0.63 mm or an additional mean gap width of 0.01 mm. On the other hand, on the outside curve 55 "second" stator packs with an "ideal" length of 1035 mm and four "second" stator packs with an "ideal" length of 1040 mm are used, while the stator end pack described above is added at one of the ends. From this there results 55·1035 mm+4·1040 mm+1·1032 mm=62,117 mm, i.e. there is an excess of only G=0.63 mm. This excess is taken into account like in the example described further above in that the stator end pack projects into the expansion gap by this amount, so that this only amounts to 85,37 mm, which is entirely tolerable. The additional mean material gap width between the stator packs is accordingly zero.

Corresponding computations can be made for a series support which is arranged between points 18 and 19 which have a spacing of 24,768 mm from one another.

The additional advantage is obtained in this way that all guideways can be assembled in a modular manner from a parts set which is cost-effective to produce, which comprises for example only three different lengths of series supports, four different lengths of middle stator packs and two different lengths of stator end packs, which can be used as middle stator packs when required. It is then merely necessary to divide the space curve 2 into sections by points 18, 19, with their lengths corresponding to the lengths of the supports used in the specific case, whereby the planning of a guideway can be substantially simplified.

The distribution of the stator packs of different lengths can be made arbitrarily in principle. However the "second" stator packs are preferably used only for outer stator sections and the "third" stator packs only for inner stator sections. Moreover it is advantageous to distribute the stator packs which deviate from the normal length (1032 mm) uniformly over the stator sections.

The invention explained with reference to the above embodiments also especially contributes advantages in planning and building a guideway with two tracks, as is explained below with reference to FIG. 10. It can moreover be applied with no problem to routes with more than two tracks.

Figure 10:
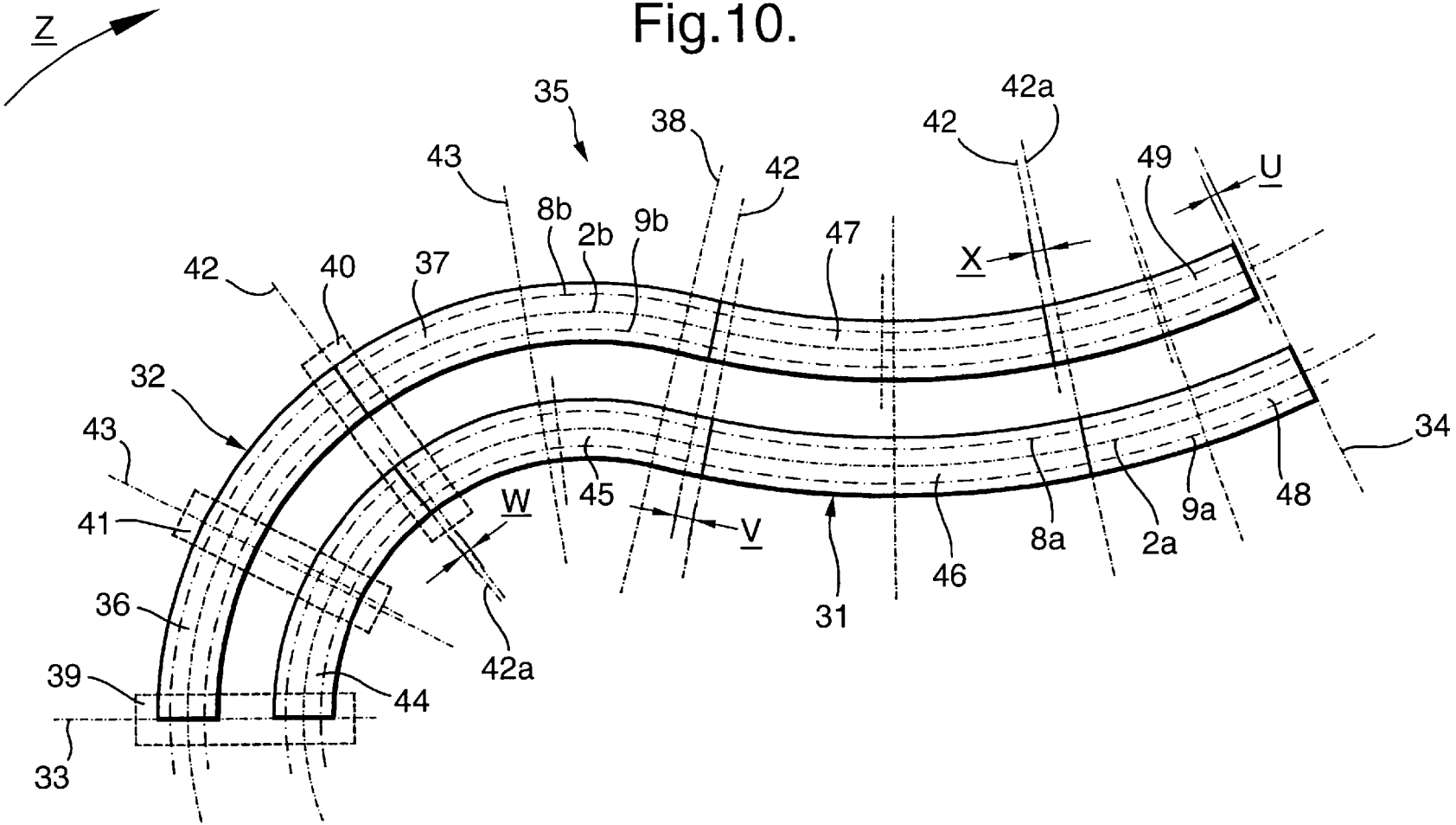
FIG. 10 shows schematically a planning section for a guideway with two tracks.

FIG. 10 shows a guideway for a magnetically levitated railway with two tracks 31 and 32, which have curved and possibly also straight sections. Each track 31, 32 is designed like the guideway according to FIGS. 1 to 9 and is therefore characterized by a space curve 2*a*, 2*b* respectively and two space curves 8*a*, 8*b* and 9*a*, 9*b* respectively, which correspond to the space curves 2, 8 and 9 according to FIG. 2. It is assumed that, in a first method step, not only these space curves but also associated fixedly imposed points 33, 34 are determined. Thus the fixed point 33 can be the start of the whole guideway for example while the fixed point 34 represents the start of a special structure, in the form of a bridge, a station or the like for example. The part of the guideway lying between the two fixed points 33, 34 is called the "planning section" 35 below.

The building of the road in the planning section 35 begins in accordance with the invention in that the distance between the two fixed points 33, 34 is firstly so determined that the space curve 2*a* of that track 31 which adjoins the second fixed point 34 with an outer track section has a length which exactly corresponds to an integral multiple of a predetermined tooth/groove pitch (here 86 mm for example). This is possible with no problem, since the start of the special structure following at the fixed point 34 can easily be placed forwards or back by the necessary amount of half the tooth/groove pitch at the maximum (here 43 mm). Furthermore, it is clear that the spacing between the two fixed points 33, 34 along the other track 32 can be greater or smaller by an amount u than an integral multiple of the predetermined tooth/groove pitch, which amount u is smaller than or at the most equal to half the pitch factor, i.e. here equal at the most to 43 mm. Finally by an "outer track section" a track section will be understood by analogy with FIGS. 2 and 4 as a track section which lies on the outside in a curve of the guideway. If a straight track section adjoins the fixed point 34 (or 33) then this is also called an outer track section, insofar as the first section deviating from the straight section is an outer section. The like applies to the inner track sections.

On this basis the planning of the supports for the guideway is now begun in a selected planning direction (arrow z) and beginning at the first fixed point 33, in that a series support 36 according to the preceding description is specified for the outer adjoining track section. Further supports 37 are then planned for the outer track section, until a change of curvature point 38 is reached, this being indicted here by a line running normal to the space curve 2*b*. The starts and ends of the series supports 36 and 37 determine the positions for schematically indicated free bearings 39 and 40, and the centers of the series supports 36 and 37 determine the positions for corresponding fixed bearings 41, which bearings are then calculated by the usual methods and supplemented by the planning of the associated pillars or other sub-structures.

Schematically indicated planes 42 or support starts and ends correspond to the planes 11 and 12 in FIGS. 2 and 4, on which the points 18 and 19 lie, and planes 43 or the support centers correspond to the planes 10, where the planes 43 and the fixed bearings 41 can also be arranged off-center relative to the supports, depending on the slope and terrain.

In principle the procedure can be carried out in like manner in relation to the inner track section adjoining the fixed point 33. On account of the shorter arc length in the inner region however this would lead to the result that an ever greater offset would occur between the starts and ends of the supports, as is indicated in the region of the change of curvature point 38 by an amount v. This offset v would be so large in unfavorable cases that the bearing for these supports could not be set up with the aid of the same pillars and sub-structures as for the outer track section, i.e. practically two completely separate guideways for the two tracks would result, which is undesirable for reasons of cost. According to the invention it is however proposed to use supports for the inner track section which are so shortened in comparison with those in the outer track section that the offset v at the ends is always below a tolerable amount.

To this end a support 44 is first provided for the inner track section, starting from the fixed point 33, with its length originally corresponding to that of the series support 36 but which is shortened by as many integral multiples of the tooth/groove pitch as necessary for making a plane 42*a* determining its end being offset from the plane 42 by an amount w which is smaller than half the tooth/groove pitch. Depending on the circumstances the support 44 can project beyond the plane 42 or terminate short of the plane 42 by this amount. The same is done for the support following in the planning direction z, e.g. with a support 45, which is fitted to the support 44 in the same manner as described fully above in connection with FIGS. 1 to 9. In accordance with the position of the next plane 42 this support 45 is also, if necessary, shortened by an integral multiple of the tooth/groove pitch, so that the offset v is here smaller than 43 mm.

Since the support 37 located on the outside projects by no more than half its length beyond the curve middle point 38, it forms the last series support of the outer section. In continuation the series supports are now used along the now outer lying track section of the track 31, in that a first series support 46 is connected to the support 45, while supports (e.g. 47) are used on the now inside track section of the track 32 which are shortened by integral multiples of the tooth/groove pitch, so that an offset x is smaller than 43 mm. This procedure is continued until either a further change of curvature point or the fixed point 34 is reached.

In the region of the fixed point 34 it is not as a rule possible to use a series support, unless this fortuitously has the required length. Accordingly, also in the outer region a support 48 can be used which is by an integral multiple of the tooth/groove pitch shorter than a series support, and the same applies for a support 49 at the end of the inner track section. It is moreover clear that, on account of the described procedure, the support 48 adjoins the fixed point 34 with a offset of zero, whereas the support 49 adjoins the fixed point with the offset u which is less than corresponds to half the tooth/groove pitch, where this support 49 can end shortly before or shortly after the fixed point 34.

If the series support 37 is so long that it projects more than half of its length beyond the change of curvature point 38, the change of the track for the series supports would begin already at the preceding support, i.e. in this case the support 45 would already be a series support and the support 37 a shortened support.

The described procedure yields the substantial advantage that the positions for the free bearings 39, 40 are given by the planning of series supports arranged along the tracks 31, 32 and the same pillars and sub-structures can be used for the free bearings of the respective shortened supports, because the offset u, v, w or x of the support ends is comparatively small and is no greater than 43 mm at any point. The same applies to the fixed bearings 41, which can be offset at the most by this amount.

After the kind and length of the various supports have been determined, these can be fitted individually with stator packs. This is effected in accordance with the above description for the series supports. It will be understood that the points 18, 19 according to FIGS. 2 and 4 are always determinative for the lengths of the individual series supports, so that "ideal" lengths measured between the planes 42 etc. are involved, as appears from the description of FIGS. 2 and 4. In relation to the shortened supports the sole difference lies in that they have a length shorter by an integral multiple of the tooth/groove pitch than the series supports. They can therefore be equipped with stator packs like the series supports, where—for each shortening by one tooth/groove pitch—e.g. a stator pack described above as a stator end pack can be used , having a material length of 945.8 mm, i.e. being shortened by one tooth/groove pitch compared with the "first" stator packs.

It follows from this that both the series supports and the stator packs of the described parts set can be used for both tracks 31 and 32, and inside supports merely have to be shortened. Furthermore at the junction at the second fixed point 34 the procedure can be followed in the same way, in that firstly a possibly existing special structure is planned on the 86 pitch and then the next track section is planned in the described manner. The whole route stretch to be constructed can be planned on the pitch once selected or divided into sections with a length corresponding to the tooth/groove pitch and then planned in the selected direction z.

The procedure described above for planning and constructing a guideway is especially advantageous when series supports of great length (e.g. 61,920 mm or 24,768 mm) are involved. When using comparatively short supports, mostly at ground level (e.g. the supports 1 according to FIGS. 2 and 4) the described method does not have to be followed as a rule, because the preparation of separate sub-structures for the supports 1 is readily possible. Shortened pieces of these supports therefore need be introduced only at the end of a guideway section formed from these supports, in order to reach the associated fixed point with an offset of less than 43 mm.

The invention is not restricted to the described embodiments, which can be modified in numerous ways. This applies in particular to the described lengths, tooth/groove pitches, assembly gaps, expansion gaps and other measurements. Suitable parts sets of supports and stator packs can naturally also be implemented with other tooth/groove pitches. It would further be possible to provide, instead of only two each different "second" and "third" stator packs and one "first" stator pack, still further "first", "second" and "third" stator packs with other than the specified lengths and/or other than the given steps, or to omit the one or other "second" or "third" stator pack, in which case different inequalities for G could arise.

It is moreover possible to provide further "third" stator packs at the junctions of the guideway at special structures, such as bridges or the like for example, in which for example a selected number of teeth/grooves is omitted completely or which are arbitrarily shortened, in order to compensate for the differential lengths required at the special structure in question or to create expansion gaps. Furthermore guideways for vehicles with more than two stators or guideways with two tracks and four stators or guideways with three or more tracks can be realized with the invention, where these tracks can be arranged in each case on the same supports or on supports mechanically coupled together and arranged on common fixed and free bearings. Finally it will be understood that the various features can also be employed in other than the illustrated and described combinations.

It will be understood that each of the elements described above, or two or more together, may also find a useful application in other types of constructions differing from the types described above.

While the invention has been illustrated and described as embodied in a magnetic levitation (maglev) system and a guideway, a parts set and a method therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint or prior art, fairly constitute essential characteristics of the generic or specific aspects of this invention.

What is claimed as new and desired to be protected by Letters Pant is set forth in the appended claims.

What is claimed is:

1. A guideway for a magnetically levitated railway, with a longitudinal stator linear drive having at least two parallel stators, comprising: a plurality of supports (1) arranged along a line and adapted to form straight and curved guideway sections, and stator sections being mounted on the supports (1), being arranged along parallel space curve sections associated therewith and being assembled from straight stator end packs (6*a, f*; 7*a, f*; 26*a, f*; 27*a, f*;) and straight middle stator packs (6*b–e*; 7*b–e*; 26*b–e*; 27*b–e*) arranged therebetween which stator end packs and middle stator packs are laid out in the region of the curved guideway sections to form outer and inner stator sections (6, 7, 26, 27) in the manner of polygonal lines and are separated from one another by gaps (23, 24), wherein said stator end packs (6*a, f*; 7*a, f*; 26*a, f*; 27*a, f*;) and said middle stator packs (6*b–e*; 7*b–e*; 26*b–e*; 27*b–e*) have, as referred to a conceptual space curve (2) lying between the two space curve sections, a predetermined tooth/groove pitch (16) as well as a small number of predetermined different "ideal" lengths, which differ from one another by fractions of said tooth/groove pitch (16), and wherein said middle stator packs (6*b–e*; 7*b–e*; 26*b–e*; 27*b–c*) are combined with one another in at least one outer or inner stator sections (6, 7, 26, 27) under consideration of said predetermined different "ideal" lengths of said middle stator packs in such a manner that a "material" total gap between all stator end packs (6*a, f*; 7*a, f*; 27*a, f*;) and said middle stator packs (6*b–e*; 7*b–e*; 26*b–e*; 27*b–e*) of said stator section (6, 7, 26, 27) has the smallest possible width.

2. A guideway according to claim 1, wherein said middle stator packs include "first" stator packs (6*c*, 26*b–e*; 27*b,c,e*) with an "ideal" length which corresponds to an integral multiple of said tooth/groove pitch (16).

3. A guideway according to claim 2, wherein said middle stator packs include "second" and "third" stator packs (6*b,d,e*; 7*b–e*; 27*d*) having "ideal" lengths which are greater or smaller than the lengths of said "first" stator packs (6*c*, 26*b–e*; 27*b,c,e*) by fractions of said tooth/groove pitch (16).

4. A guideway according to claim 3, wherein said "second" and "third" stator packs (6*b,d,e* and 7*b–e*, 27*d*) and said stator end packs (6*a,f*; 7*a,f*; 26*a,f*; 27*a,f*;) have a tooth/groove pitch (16) corresponding to said tooth/groove pitch (16) of said "first" stator packs (6*c*; 26*b–e*; 27*b,c,e*) and that said greater or smaller "ideal" lengths are obtained by corresponding extension or shortening of end teeth (17*b,c*).

5. A guideway according to claim 3, wherein said "second" and "third" stator packs and said stator end packs have a tooth/groove pitch which is greater or smaller than said tooth/groove pitch of the "first" stator packs (6*c*; 26*b–e*; 27*b,c,e*) by an amount corresponding to their greater or smaller "ideal" length.

6. A guideway according to claim 3, wherein said "second" and "third" stator packs and the stator end packs have a tooth width which, with the groove width unchanged, is greater or smaller than a tooth width of the "first" stator packs by an amount corresponding to their greater or smaller "ideal" length.

7. A guideway according to claim 1, wherein said supports (1) are laid out between points (18, 19) of said space curve (2) which have spacings from one another corresponding to an integral multiple of the tooth/groove pitch (16).

8. A guideway according to claim 7, wherein said spacings of said points (18, 19) predominantly correspond also to integral multiples of said "ideal" lengths of said "first" stator packs (6*c*, 26*b–e*; 27*b,c,e*).

9. A guideway according to claim 7 or 8, wherein said supports are selected from a predetermined small number of series supports of different lengths an wherein the spacings between said points (18, 19) are selected in correspondence with the lengths of said series supports.

10. A guideway according to claim 7, wherein said points (18, 19) lie in planes (11, 12) aligned normal to said space curve (2).

11. A guideway according to claim 1, wherein expansion gaps (20*a*, 21*a*) are provided between stator sections of two supports (1) adjoining one another in the line direction and wherein the stator end packs (6*a, f*; 7*a, f*; 26*a, f*; 27*a, f*;) associated therewith have a length which comprises a "material" length which is smaller than the length of said "first" stator packs (6*c*, 26*b–e*; 27*b,c,e*) by a fraction fo said tooth/groove pitch (16), taking into account the size of the expansion gaps (20*a*, 21*a*).

12. A guideway according to claim 1, wherein expansion gaps (20*a*, 21*a*) are provided between stator sections of two supports (1) adjoining one another in the line direction and the stator end packs associated therewith are shortened by one tooth/groove pitch (16) compared with the "first" stator packs (6*c*; 26*b–e*; 27*b,c,e*).

13. A guideway according to claim 1, wherein said "second" stator packs (6*d,b,e*) are used only within said outer stator sections (6, 26) and said "third" stator packs (7*b–c*; 27*d*) are used only within said inner stator sections (7, 27).

14. A guideway according to claim 1, wherein said stator end packs (6*a, f*; 7*a, f*; 26*a, f*; 27*a, f*;) and said middle stator packs (6*b–e*; 7-*e*; 26*b–e*; 27*b–e*) within the outer and inner stator sections (6, 7, 26, 27) are so combined with one another that $-1\ \text{mm} \leqq G < 2\ \text{mm}$ applies, where G is a difference between the lengths of the space curve sections associated with the stator sections (6, 7, 26, 27) and a sum of the "ideal" lengths of said stator end packs (6*a,f*; 7*a,f*; 26*a,f*; 27*a,f*;) and middle stator packs (6*b–e*; 7*b–e*; 26*b–e*; 27*b–e*) contained within said stator sections (6, 7, 26, 27).

15. A method of making a guideway for a magnetically levitated railway with curved and optionally also straight guideway sections, which form at least two tracks (31, 32), are provided with stators of a longitudinal stator linear motor for each track und have outer and inner track sections in correspondence with their curvature, comprising the steps of: establishing two space curves (2*a*, 2*b*) associated with the tracks (31, 32), at least one first and one second fixedly imposed point (33, 34) and a planning section (35) disposed between said points (33, 34); arranging supports (36, 37, 44–49) and bearings thereof for the guideway and said stators along said planning section; providing said supports (36, 38, 44–49) with stator packs forming said stators; determining a spacing between the two fixedly imposed points (33, 34) so that the space curve (2*a*) of that track (31) which adjoins the second fixedly imposed point (34) with an outer track section has a length which corresponds to an integral multiple of a predetermined tooth/groove pitch (16) for the guideway; providing a series support set, said set comprising series supports with a small number of different lengths; arranging—b y starting from said first fixedly imposed point (33)—selected ones of said series supports (36, 37, 44–49) along outer track sections while other supports (44, 45, 47, 49) are arranged along inner track sections, wherein said other supports are shorter than said series supports (36, 37, 44–49) by integral multiples of said tooth/groove pitch (16) in such a manner that ends of said other supports along said innertrack sections are offset relative to ends of associated ones of said series supports (36, 37, 44–49) of said outer track sections by half a tooth/groove pitch at the most, and fitting said series supports and said other supports (36, 37, 44–49) with stator packs and stator end packs.

16. A parts set for building guideways for a magnetically levitated railway with a longitudinal stator linear motor having at least two parallel stators, comprising a plurality of stator packs (6*b–e*; 7*b–e*; 26*b–e*; 27*b–e*) stator end packs (6*a,f*; 7*a,f*; 26*a,f*; 27*a,f*;) and series supports (1) according to claim 15.

17. A method according to claim 15, wherein a case in which a last support (48) of said outer track section adjoining said second fixedly imposed point (34) would have a length projecting beyond said second fixedly imposed point (34), said last support (48) is so shortened by an integral multiple of the tooth/groove pitch (16) that said last support adjoins the second fixedly imposed point (34) without an offset.

18. A method according to claim 15, wherein on reaching a change of curvature point (38), a series support (37) crossing over said change of curvature point (38) is only laid along the track sections which is the outer one before said change of curvature points (38) if it extends beyond said change of curvature point (38) by no more than half its length, and wherein otherwise a series support is laid on that track section which lines on the outside after said change of curvature point (38).

* * * * *